US005353639A

United States Patent [19]

Brookins et al.

[11] Patent Number: 5,353,639

[45] Date of Patent: Oct. 11, 1994

[54] METHOD AND APPARATUS FOR SIZING MULTIPLE TUBES

[75] Inventors: James R. Brookins; James D. Gowan, both of Montgomery, Ala.

[73] Assignee: Thermalex, Inc., Montgomery, Ala.

[21] Appl. No.: 63,742

[22] Filed: May 20, 1993

[51] Int. Cl.[5] ..... B21C 37/30

[52] U.S. Cl. ..... 72/363; 72/367

[58] Field of Search ..... 72/363, 367; 29/890.053, 890.054

[56] References Cited

U.S. PATENT DOCUMENTS

| | | | |
|---|---|---|---|
| 3,024,521 | 3/1962 | Polk | 29/890.054 |
| 4,527,411 | 7/1985 | Shinosaki et al. | 29/890.053 |
| 5,058,266 | 10/1991 | Knoll | 29/890.053 |

*Primary Examiner*—Lowell A. Larson
*Attorney, Agent, or Firm*—Mason, Fenwick & Lawrence

[57] ABSTRACT

A sizing die for sizing a plurality of micro-extruded tubes has a side fence, a clamping fence in substantial parallel relation with and movable with respect to the side fence, a base fence adjacent to and perpendicular to ends of the side fence and the clamping fence, and a movable die platen for applying pressure to the top of the stack of tubes. The side and base fences preferably are fixed. The tubes to be sized are stacked on their sides against the side fence with their internal webs aligned throughout. The clamping fence and die platen are moved to be in mating engagement with the stack. Pressure is applied through the die platen against the top of the stack to compress the tubes to a desired thickness.

5 Claims, 1 Drawing Sheet

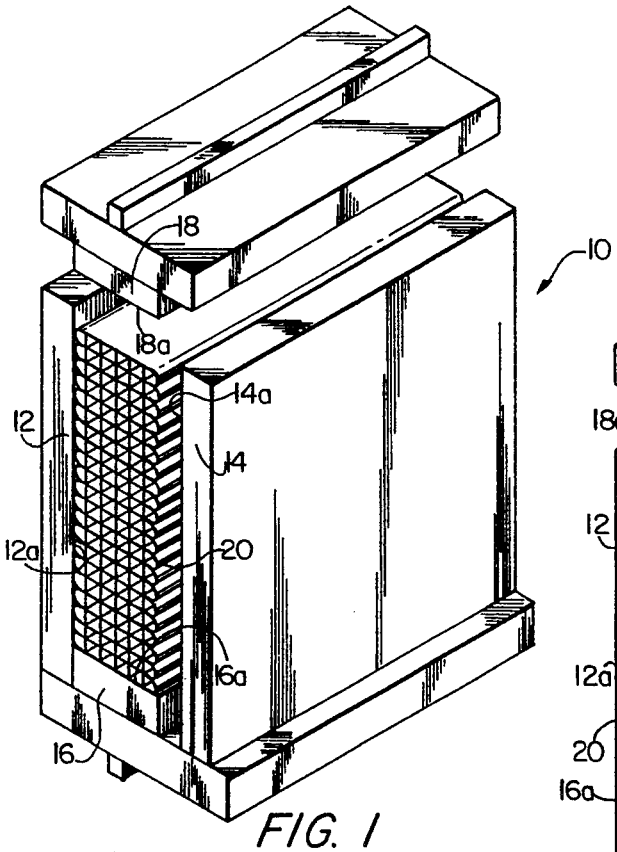
FIG. 1
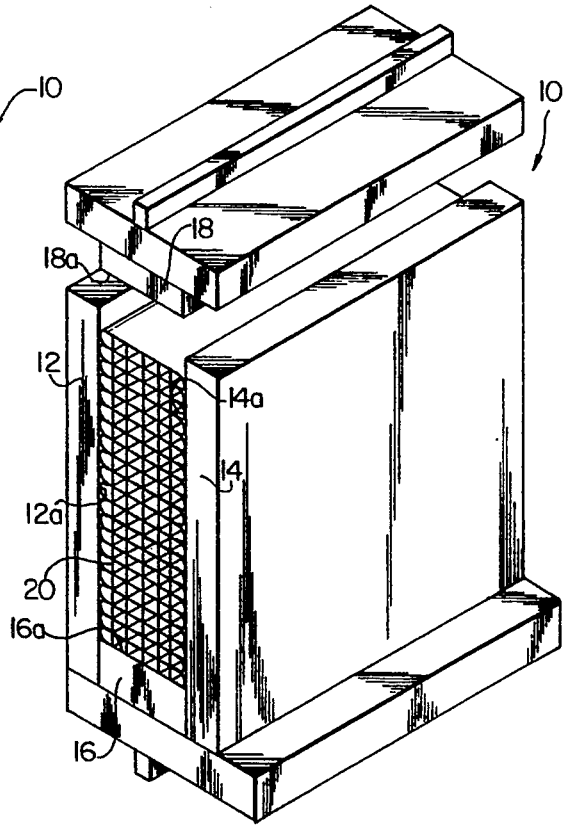
FIG. 2
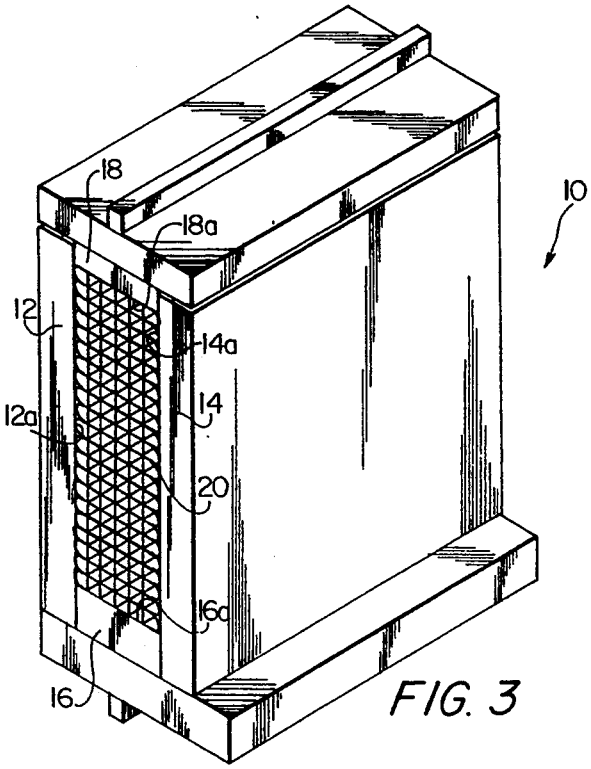
FIG. 3
FIG. 4
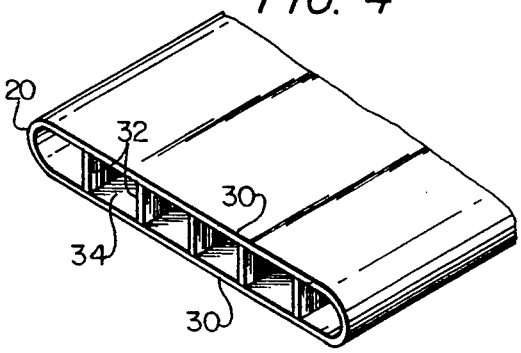

METHOD AND APPARATUS FOR SIZING MULTIPLE TUBES

BACKGROUND OF THE INVENTION

1. Field of the Invention

The present invention relates to tube sizing devices, and more particularly, to a method and apparatus for sizing flat, multi-void, extruded tubes for automotive heat exchangers.

2. Description of the Invention

Conventional aluminum heat exchangers were manufactured with relatively long pieces of multi-void tubing (i.e., tubing in which the interior space is divided into multiple longitudinal voids by a plurality of longitudinal webs), and then bent into a serpentine configuration. Although these serpentine heat exchangers were satisfactory with fluorocarbon refrigerants R-12 and R-22, they did not perform well with CFC-134a.

A new configuration of condenser core thus was developed for use with CFC-134a: the micro-multi-void extrusion. These micro-extrusions (referred to herein as "micro-extruded tubes") are cut to length and assembled to make up a series of parallel paths for the refrigerant to flow through.

However, prior art extrusion technology originally could not produce a tube with micro-multi-voids to the extremely tight tolerances required in the manufacture of parallel-flow condenser coils. The prior art thus developed tube sizing technology which could control the thickness of the micro-extruded tubes. Currently, there are two methods in use in the art. The first method is rolling, in which the microtube is passed through a series of rollers which reform the material to a predetermined size. The roller sizing machines which are used in the rolling method generally are fed microtubes from a coil of material. The rolling method is very slow and costly to perform.

U.S. Pat. No. 5,058,266 to Knoll is illustrative of the rolling method. As disclosed by Knoll, the tubes as initially extruded have an oval shape with two transverse webs connecting the long sides of the oval. The tube is then rolled under pressure, flattening the oval sides and comprising and bending the transverse webs. In addition, there is disclosed a similar rolling operation for tubes having one or two internal fins which initially do not extend entirely to the far wall of the tube. However, upon rolling, the two sides of the tube are flattened, and the internal fins do not contact the far wall of the tube.

A second method in use in the art is a compression method, in which a die is sized to hold a single tube. The tube is placed in the die and compressed to reach the desired size. The compression method also is very slow and costly to perform, because it treats only a single tube at a time.

U.S. Pat. Nos. 3,776,018 and 3,662,582 to French are illustrative of the compression method. As disclosed by French, heat exchanger tubing of an oval cross section with two parallel opposite sides is made by compressing tubes initially having a circular cross section and short internal fins. The internal fins act as spacers to prevent excessive compression of the tube. After the compression step, the walls of the tube are partially separated by fluid pressure.

Compression has also been used generally for sizing single tube blanks, both for heat exchangers and other applications.

In U.S. Pat. Nos. 4,829,803 and 4,744,237 to Cudini, a box-like frame member is formed by compressing a tube blank into a square shape between two matching dies. Each die has a rectangular groove in it, such that when the two dies are brought together they compress a tube of circular or similar cross section into a rectangular cross section shape.

In U.S. Pat. No. 4,527,411 to Shinosaki et al., the circular tube is heated to a temperature of 550° to 1250° C. and compressed within a box-like form having three sides by the application of pressure through a compressing side.

In U.S. Pat. No. 4,204,309 to Lefrancois, a process of compressing hollow bead rings for the beads of pneumatic tires. The beads have an oval or diamond-shaped cross section, with a web extending from one of the longer sides partially across the cross sectional distance. The opposite wall of the tube may have a mating surface into which the transverse webs fit at the end of the compression step. However, no particular compression method is specified.

According to the above-discussed references, only one tube is sized at a time in a die that has been designed to hold only one tube during the application of the sizing pressure. Thus, the method is also relatively slow and expensive. It is the solution to these and others objects to which the present invention is directed.

SUMMARY OF THE INVENTION

Accordingly, it is a principle object of the present invention to provide a method and apparatus for sizing a plurality of tubes, and particularly micro-extruded tubes, at one time.

It is another object of the invention to provide a method and apparatus for sizing multi-void, micro-extruded tubes suitable for use in a parallel flow-type of heat exchanger, such as a condenser coil.

It is a further object of the invention to provide an efficient and less expensive method of making automotive heat exchangers.

To achieve these objects, a sizing die according to the present invention is herein provided. The sizing die comprises a fixed side fence and a movable clamping fence which is parallel to the fixed side fence. A fixed base fence is disposed adjacent to ends of the fixed side fence and the clamping fence, and extends perpendicular to the fixed side fence and the clamping fence. A movable die platen is positioned parallel to the fixed base fence and between the fixed side fence and the movable clamping fence. The die platen has a mating surface having substantially the same dimensions as a side of the tube blanks to be sized.

Each of the micro-extruded tubes to be sized has a flattened oval cross section, a pair of substantially planar side surfaces disposed in parallel relation to each other, and at least one internal web extending through the tube and perpendicular to the planar side surfaces.

In the method according to the invention, a predetermined number of micro-extruded tubes are stacked on the base fence between the fixed side fence and the clamping fence. The internal webs of the tubes are aligned throughout the stack, perpendicular to the plane of the base fence. The clamping fence is moved toward the stack of tubes to prevent the stack from moving laterally. The die platen is moved toward the stack of tubes and the mating surface of the die platen is in mating engagement with a side surface of the uppermost tube in the stack. A predetermined amount of pressure is applied to the stack of tubes through the die platen. The pressure is applied equally across the entire side surface of the uppermost tube and is transmitted equally through all the tubes of the stack in the sizing die.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 1 is a perspective view of a sizing die in accordance with the present invention, with the clamping fence and the die platen in their open positions.

FIG. 2 is a perspective view of the sizing die of FIG. 1, with the clamping fence being in the closed position to fix the tubes to be sized against lateral movement.

FIG. 3 is a perspective view of the sizing die of FIG. 1, with the clamping fence and the die platen being in their closed positions.

FIG. 4 is a perspective view of a micro-extruded tube to be sized.

DETAILED DESCRIPTION OF THE PREFERRED EMBODIMENTS

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring particularly to the drawings, there is shown in FIGS. 1 through 3 an open sizing die 10 comprising die fences 12, 14, and 16, and die platen 18 which define a cavity 20 having an approximately rectangular cross section throughout. Fixed side fence 12 has a substantially planar inner surface 12*a*. Clamping fence 14 is movable toward fixed side fence 12 and has a planar inner surface 14*a* parallel to inner surface 12*a* of fixed side fence 12. Base fence 16 is disposed adjacent to ends of fixed side fence 12 and clamping fence 14. Inner surface 16*a* of base fence 16 is perpendicular to inner surface 12*a* of fixed side fence 12 and inner surface 14*a* of clamping fence 14. Die platen 18 has a mating surface 18*a* parallel to inner surface 16*a* of base fence 16.

As best shown in FIG. 4, a micro-extruded tube 20 for sizing in die 10 has two substantially planar opposite side surfaces 30. The dimensions of mating surface 18*a* of die platen 18 are substantially the same as those of the side surfaces 30 of micro-extruded tubes 20 to be sized.

At least one internal web 32 projects inwardly from side surface 30 substantially perpendicular to side surfaces 30. Internal webs 32 are of the same height and are preferably equally spaced. Internal webs 32 extend the full length of micro-extruded tube 20, so that the interior of micro-extruded tube 20 is divided into individual flow channels 34.

In use, micro-extruded tubes 20 are stacked in die 10 between fixed side fence 12 and clamping fence 14, with the lowermost micro-extruded tube resting on base fence 16. Internal webs 32 are aligned throughout the whole stack, and are perpendicular to base fence 16. Clamping fence 14 is moved towards fixed side fence 12 to a position where inner surface 14*a* of clamping fence 14 is in mating engagement with the stack of micro-extruded tubes 20. Clamping fence 14 is fixed into position against the stack of micro-extruded tubes 20 to prevent any lateral movement of micro-extruded tubes 20 during the sizing operation.

Die platen 18 is then moved toward the stack of micro-extruded tubes 20 so that its mating surface 18*a* is in mating engagement with upper side surface 30 of the uppermost micro-extruded tube 20 in the stack. A predetermined amount of pressure is applied equally across upper side surface 30 of the tube 20 at the top end of the stack, and is transmitted equally throughout all micro-extruded tubes 20 within sizing die 10 to cause all micro-extruded tubes 20 to be compressed equally, resulting in an equal reduction in the thickness of all of micro-extruded tubes 20 (i.e., the dimension of all of micro-extruded tubes 20 between side surfaces 30) and an accompanying increase in the tube length.

Movement of die platen 18 to achieve the required pressure can be achieved in any conventional manner, for example, through hydraulic, pneumatic, mechanical or electrical means or any combination of these means. These pressure applying procedures are generally well known among those skilled in the art, and therefore are not described in detail herein.

Because a plurality of micro-extruded tubes can be sized at the same time by the sizing die, productivity is dramatically increased compared with prior methods. Another advantage of this invention is that the thickness of the extruded micro-extruded tubes can be controlled by the amount of pressure applied. Thus, the extrusion procedure produces the cross section illustrated to a very high degree of accuracy, uniformity and repeatability.

Microtubes frequently are coated with a substance intended to enhance or protect the properties of the base metal. This coating causes the microtubes to have a rough, sandpaper-type texture, which is undesirable. A further advantage of the method in accordance with the invention is that the micro-extruded tubes sized according to this invention have a smooth exterior surface condition.

A further advantage of this invention is that the tubes produced by the procedure according to this invention exhibit very small amounts of core bow, thus reducing problems normally associated with core bow during the core assembly process.

Although preferred embodiments of the present invention have been described herein in detail, it would be appreciated by those skilled in the art that various modifications and alterations can be made to these embodiments without materially departing from the novel teachings and advantages of this invention. For example, the apparatus in accordance with the present invention can be used to size tubes other than micro-extruded tubes in accordance with the method of the present invention.

Accordingly, it is to be understood that all such modifications and alterations are included within the scope of the invention as defined by the following claims.

What is claimed is:

1. A method of sizing tubes, comprising the following steps:

providing a plurality of tubes having a predetermined length and width, each of the tubes having a flattened oval cross-section, a pair of substantially planar side surfaces, and at least one internal longitudinal web extending therein perpendicular to the planar side surfaces;

providing a sizing die having a box-like cavity for receiving the tubes, the sizing die having a pair of parallel, spaced apart side fences having inner surfaces extending at least the full length of the sides of the tubes being sized, at least one of the side fences being movable relative to the other side fence between and open position and a closed position, and a base fence, the base fence being disposed adjacent to and extending perpendicular to ends of the side fences, the cavity being at least in part defined by the inner surfaces of the side fences and the base fence;

stacking the tubes in a stack in the box-like cavity of the sizing die between the side fences and aligning the internal webs of tubes throughout the stack, the stack having a bottom end adjacent the base fence and a top end opposite the bottom end;

moving the movable side fence toward the other side fence to fix the tubes against lateral movement; and applying pressure equally across the entire planar side surface of the top end of the stack of tubes in a direction towards the base fence, thereby sizing and flattening the tubes consistently and evenly.

2. The method of forming tubing of claim 1, further comprising the step of providing a movable die platen in parallel spaced relation to the base fence, and wherein in said pressure-applying step, said die platen is moved from an open position to a closed position to provide pressure against the top end of the stack of tubes.

3. A sizing die for sizing tubes having substantially planar opposed sides, comprising:

a side fence having a substantially planar inner surface extending at least the full length of the tubes being sized;

a clamping fence in substantial parallel relation with said side fence, said clamping fence having a substantially planar inner surface extending at least the full length of the tubes being sized and being movable relative to said side fence from an open position to a closed position;

a base fence adjacent to and perpendicular to ends of said side fence and said clamping fence, said base fence having an inner surface, said inner surfaces of said side fence, said clamping fence, and said base fence defining a cavity for receiving a plurality of tubes stacked on their sides; and a die platen for applying pressure to the top of the stack of tubes, said die platen being in parallel spaced relation to said base fence and movable between an open position and a closed position, and said die platen having a mating surface for contacting the top of the stack of tubes, said mating surface having substantially the same dimensions as the sides of the tubes being sized, whereby said mating surface will contact the entire upper surface of the top of the stack of tubes.

4. The sizing die of claim 3, wherein said side fence is fixed.

5. The sizing die of claim 3, wherein said base fence is fixed.

* * * * *